US007207356B2

(12) United States Patent
Patel et al.

(10) Patent No.: US 7,207,356 B2
(45) Date of Patent: Apr. 24, 2007

(54) THROUGH AIR DRYER FABRIC

(75) Inventors: Sanjay Patel, Summerville, SC (US); Jeff Herman, Cynwyd, PA (US)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 11/131,987

(22) Filed: May 18, 2005

(65) Prior Publication Data

US 2006/0003655 A1 Jan. 5, 2006

Related U.S. Application Data

(60) Provisional application No. 60/572,623, filed on May 19, 2004.

(51) Int. Cl.
*D21F 7/08* (2006.01)
*D03D 25/00* (2006.01)

(52) U.S. Cl. ..... 139/383 A; 139/383 AA; 139/420 A; 162/358.2; 162/900

(58) Field of Classification Search ..... 139/383 A, 139/383 AA, 420 A; 162/358.2, 902
See application file for complete search history.

(56) References Cited

U.S. PATENT DOCUMENTS

| | | | | | |
|---|---|---|---|---|---|
| 3,573,164 | A | * | 3/1971 | Friedberg | 162/348 |
| 3,858,623 | A | * | 1/1975 | Lefkowitz | 139/425 A |
| 4,290,209 | A | * | 9/1981 | Buchanan et al. | 34/123 |
| 4,438,788 | A | * | 3/1984 | Harwood | 139/383 AA |
| 4,621,663 | A | * | 11/1986 | Malmendier | 139/383 A |
| 4,755,420 | A | * | 7/1988 | Baker et al. | 428/222 |
| 4,815,499 | A | * | 3/1989 | Johnson | 139/383 A |
| 5,407,737 | A | * | 4/1995 | Halterbeck et al. | 442/195 |
| 5,449,026 | A | | 9/1995 | Lee | 139/383 A |

FOREIGN PATENT DOCUMENTS

GB 2 104 565 3/1983

* cited by examiner

*Primary Examiner*—Robert H Muromoto
(74) *Attorney, Agent, or Firm*—Taylor & Aust, P.C.

(57) ABSTRACT

A through-air dryer (TAD) fabric formed by interweaving of a warp yarn system with a weft yarn system. The TAD fabric has a paper side with a contact area between 20% and 30%. The warp yarn system includes flat warp yarns and/or the weft yarn system includes flat weft yarns which have not been subjected to a sanding process after weaving of the fabric and which have an aspect ratio of 1.15:1 to 1.35:1.

7 Claims, 4 Drawing Sheets

THROUGH AIR DRYER FABRIC

CROSS REFERENCE TO RELATED APPLICATIONS

This is a non-provisional application based upon U.S. provisional patent application Ser. No. 60/572,623, entitled "THROUGH AIR DRYER FABRIC", filed May 19, 2004.

BACKGROUND OF THE INVENTION

1. Field of the Invention

The present invention relates to improvements in through-air dryer (TAD) fabrics, in particular for use on tissue-making machines.

2. Description of the Related Art

A typical tissue-making machine includes a forming section, such as a C-former, wherein the fibrous slurry is injected between two forming wires with the web forming on the outer wire. The TAD section is positioned between the forming section and yankee dryer cylinder, and typically includes at least one large diameter TAD roll or cylinder with a perforated or honeycomb working surface, hot air being passed through the surface of the roll and the TAD fabric with the paper web thereon.

In the art, TAD fabrics are usually made of PET monofilament that has been modified for high temperature applications. TAD fabrics are coarser than a forming fabric, but finer than a standard dryer fabric. Typical dryer fabrics have over 100% warp cover, including two or more layers of warp yarns, which overlap so that all fabric areas are covered, in some regions by a double layer of yarn. TAD fabrics are much more open, with typical warp coverage of about 60%.

A TAD fabric needs sufficient open area to allow air to pass through, once it has passed through the paper web, so as to promote efficient drying. The fabric must also have a high sheet contact area on the face side of the fabric to ensure successful sheet transfer to the yankee cylinder from the TAD. A standard TAD fabric directly after weaving has a contact area of about 6–12%. For effective sheet transfer, a contact area of 20–30% with a target of 25% is required. Up to the present, this has been achieved by sanding the fabric after weaving, see for example U.S. Pat. No. 3,573,164 and GB-A-2104565.

A number of problems are created through the use of sanding. One problem which arises in sanding is that some or all of the top half of the circular cross-sectional yarn is removed which results in significant or severe weakening of the yarns, in turn rendering the whole fabric inherently weak, or less stable.

The fabrics are made using highly drawn and as such highly tenacious polyester warp yarns. These yarns have high crystallinities and high molecular orientations as a result of the extrusion process. When such yarns are sanded in the lengthwise direction, the surface of the yarns become very rough. Following installation of the fabric, when high pressure showers are in use, the yarns tend to fibrillate, small pieces of yarn peeling away and often ending up in the cross-over point of the weave. This process is accelerated by temperature, so making the fabric edges particularly vulnerable.

There have been difficulties with the sanding process itself in that preferential sanding of the fabric occurs, whereby the new sand paper gradually becomes worn down, so loosing efficiency, until it again needs to be replaced. After sanding there have also been difficulties in removing the abraded dust from the fabric, due to static charges, due to which the dust often gets into the yarn cross-over points which can cause problems from the outset.

Additional problems are that sanding is a notoriously slow and thus costly process and also has serious health risks associated with it due to the dry dusty environment in which it must be carried out.

The use of flat yarns in papermachine fabrics has been proposed, notably as summarized in the introductory part of U.S. Pat. No. 5,407,737 (Halterbeck) which is concerned with a dryer screen including flat yarns obtained by flattening tubular yarns of a circular cross-section. U.S. Pat. No. 5,449,026 (Lee) proposes a multilayer dryer fabric with several layers of machine direction flat yarns woven therein. The use of high aspect ratio yarns of over 3:1 is discussed, and the drawings illustrate tape-like yarns with an aspect ratio of 6:1. The aspect ratio is the ratio of the width to the thickness of the yarn, expressed as W/E. Such wide flat yarns provide good yarn cover in the fabric and are thus useful to restrict air and water permeability, and they also produce a low weave thickness as compared with round yarns giving the same cover. However during weaving care must be taken to avoid imparting any degree of twist to the flat yarns as a twist in such a flat yarn occupies a thickness related to the width of the yarn, and produces a pronounced irregularity in the weave.

What is needed in the art is a through-air dryer fabric with flat warp yarns and/or flat weft yarns which does not require sanding.

SUMMARY OF THE INVENTION

The present invention provides a through-air dryer fabric with flat warp yarns and/or flat weft yarns which have not been subjected to sanding.

The invention comprises, in one form thereof, a through-air dryer (TAD) fabric formed by interweaving of a warp yarn system with a weft yarn system, the TAD fabric has a paper side having a contact area between 20% and 30%, wherein the warp yarn system includes flat warp yarns and/or wherein the weft yarn system includes flat weft yarns which have not been subjected to a sanding process after weaving of the fabric and which have an aspect ratio of 1.15:1 to 1.35:1.

The yarns may be of a generally rectangular cross-section, extruded in that form to provide an aspect ratio within the specified range more preferably about 1.27:1. Such a yarn would have flat top and bottom surfaces with flat or convex side surfaces. Other possible cross-sections include oval or elliptical or semi-circular cross-sectioned yarns.

The TAD fabric according to the present invention preferably has an air permeability in the range of 400 cfm to 1000 cfm, most preferably in the range of 600 cfm to 1000 cfm.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
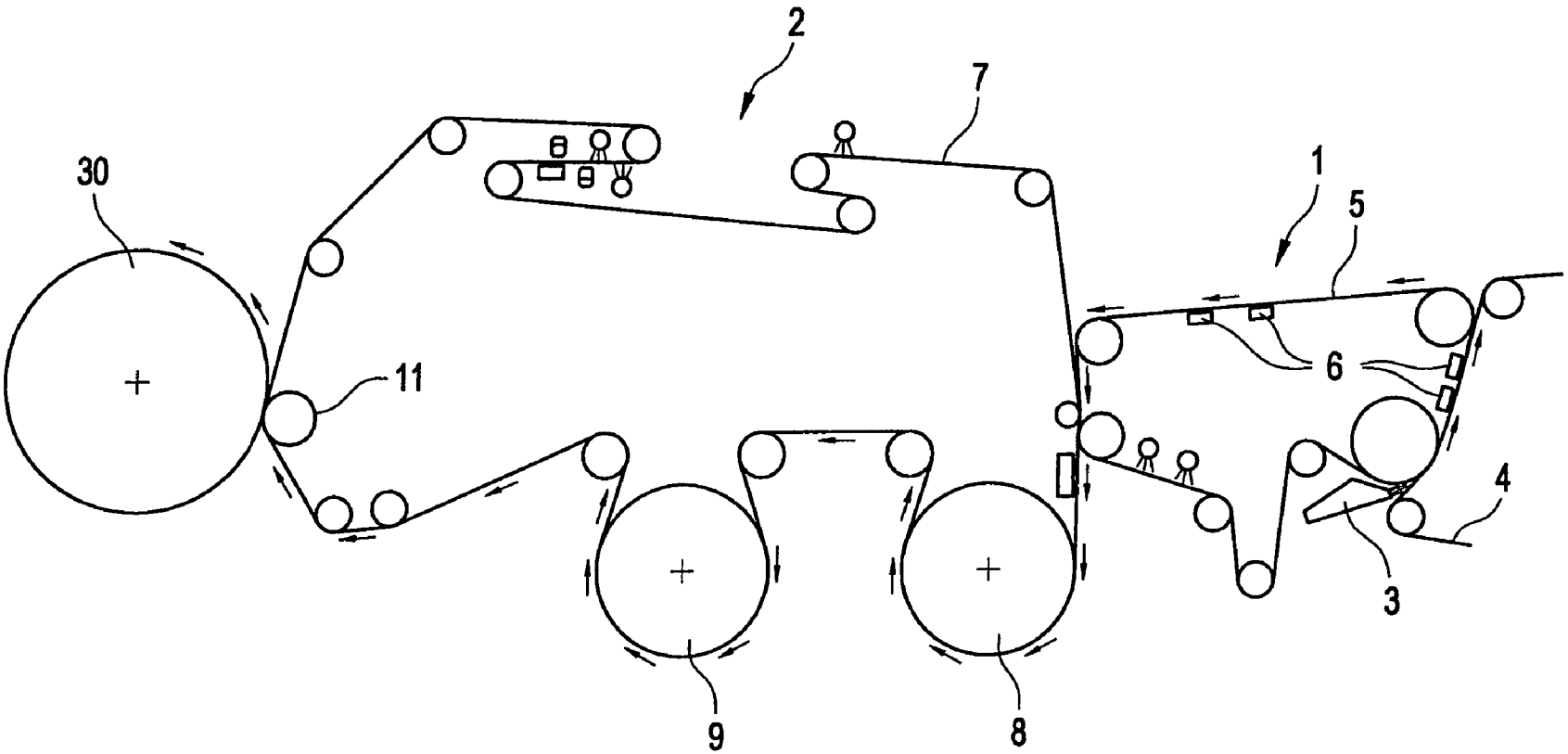
FIG. 1 is a schematic side view showing the general arrangement of a tissue making machine with a yankee cylinder, which uses a TAD fabric in accordance with the present invention.

Referring now to the drawings, and more particularly to FIG. 1, there is shown a tissue making machine which generally includes a forming section 1, a series of through air dryers in the center section 2, and a yankee cylinder 30.

In the forming cylinder section 1, cellulose fibers are discharged as a slurry from a headbox 3 between forming wires 4 and 5 and subsequently carried forward on fabric 7. Dewatering is assisted by suction boxes 6 disposed on the roller side of the forming wire. The web formed on the wires 4 and 5 is then transferred to a TAD fabric 7 which transports the web around two TAD installations 8, 9 and to the yankee cylinder 30.

At this point roller 11 presses the paper sheet onto the yankee cylinder after which the sheet is crêped and then goes to a take up reel (not shown).

The TAD fabric 7 is a fabric in accordance with the present invention, which has a contact surface area of around 25%.

Figure 2:
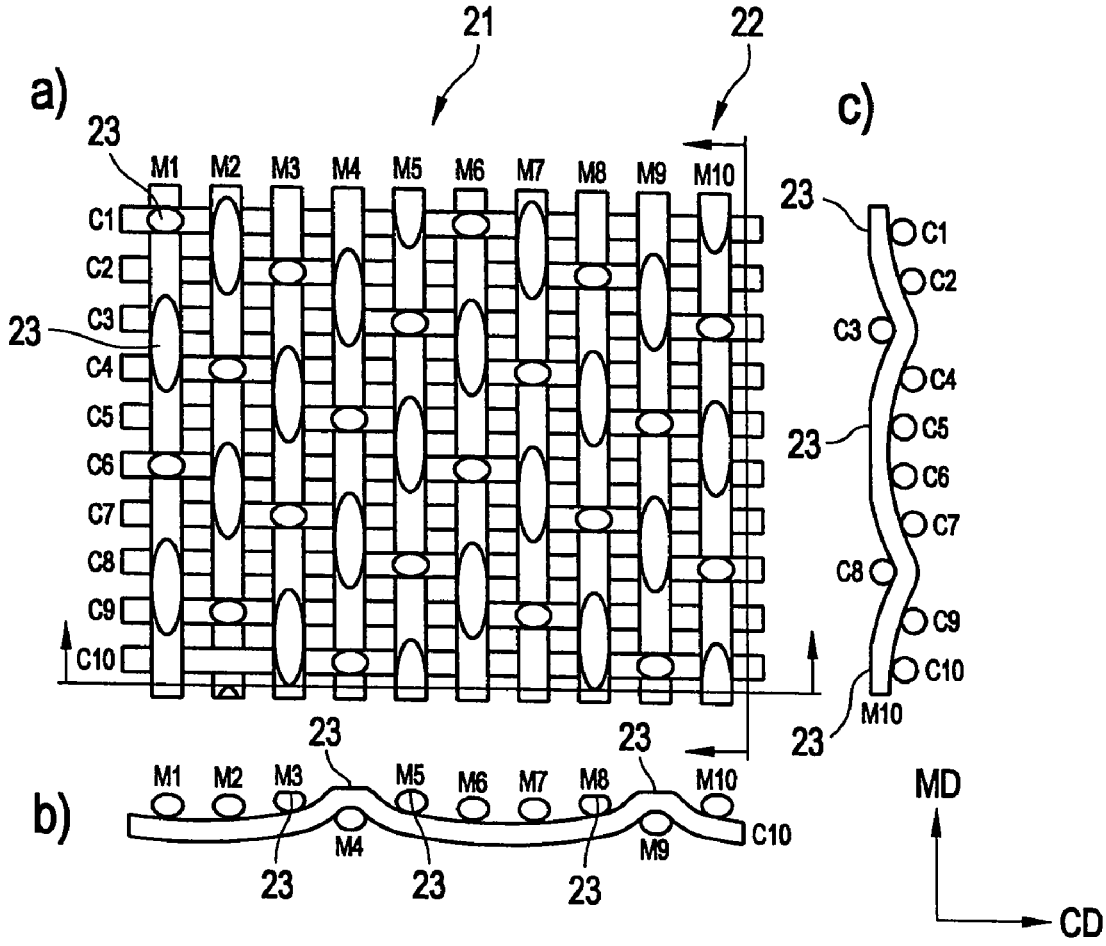
FIG. 2 is a top view of the paper contacting surface and corresponding side views in machine direction (MD) and cross-machine direction (CD) direction on a TAD fabric known in the art.

FIG. 2*a* shows a top view onto a section of paper side 22 of a sanded TAD fabric 21 known in the art. In CD direction the TAD fabric 21 has a "over 1 under 4" weave repeat. In MD direction the TAD fabric has a "over 4 under 1" weave repeat. The weave pattern is formed by interweaving of the warp yarns M1, M2, M3, . . . extending into MD direction with the weft yarns C1, C2, C3, . . . extending into CD direction. Both warps M1, M2, M3, . . . and wefts C1, C2, C3, . . . of fabric 21 are originally circular shaped and later sanded to provide flattened sanded areas 23 on the paper side 22 of the TAD fabric 21. This denotes that the TAD fabric 21 is woven with circular shaped yarns M1, M2, M3, . . . and C1, C2, C3, . . . which were later flattened by a sanding process. By doing so the contact area on the paper side 22 can be increased from approximately 6% to 12% after weaving to approximately 20% to 30% after sanding.

FIG. 2*b* shows a side view in CD direction of TAD fabric 21 along weft yarn C10. As can be seen C10 first passes over one warp before floating under four consecutive warps. For example, C10 passes over M4 and floats under M5 to M8 before passing over M9 and so on.

Further, it can be seen that C10 has flattened sanded areas 23 when passing over M4 and M9 and that the warps positioned adjacent on both sides of M4 and M9 also form flattened sanded areas 23 to provide a paper side 22 with enhanced contact area.

FIG. 2*c* shows a side view in MD direction of TAD fabric 21 along warp yarn M10. As can be seen M10 first floats over four consecutive wefts before passing under one weft. For example, M10 floats over C4 to C7 and passes under C3 before and so on.

Further, it can be seen that M10 has flattened sanded areas 23 generated by a sanding process when floating over C4 to C7 to provide a paper side 22 with enhanced contact area.

Figure 3:
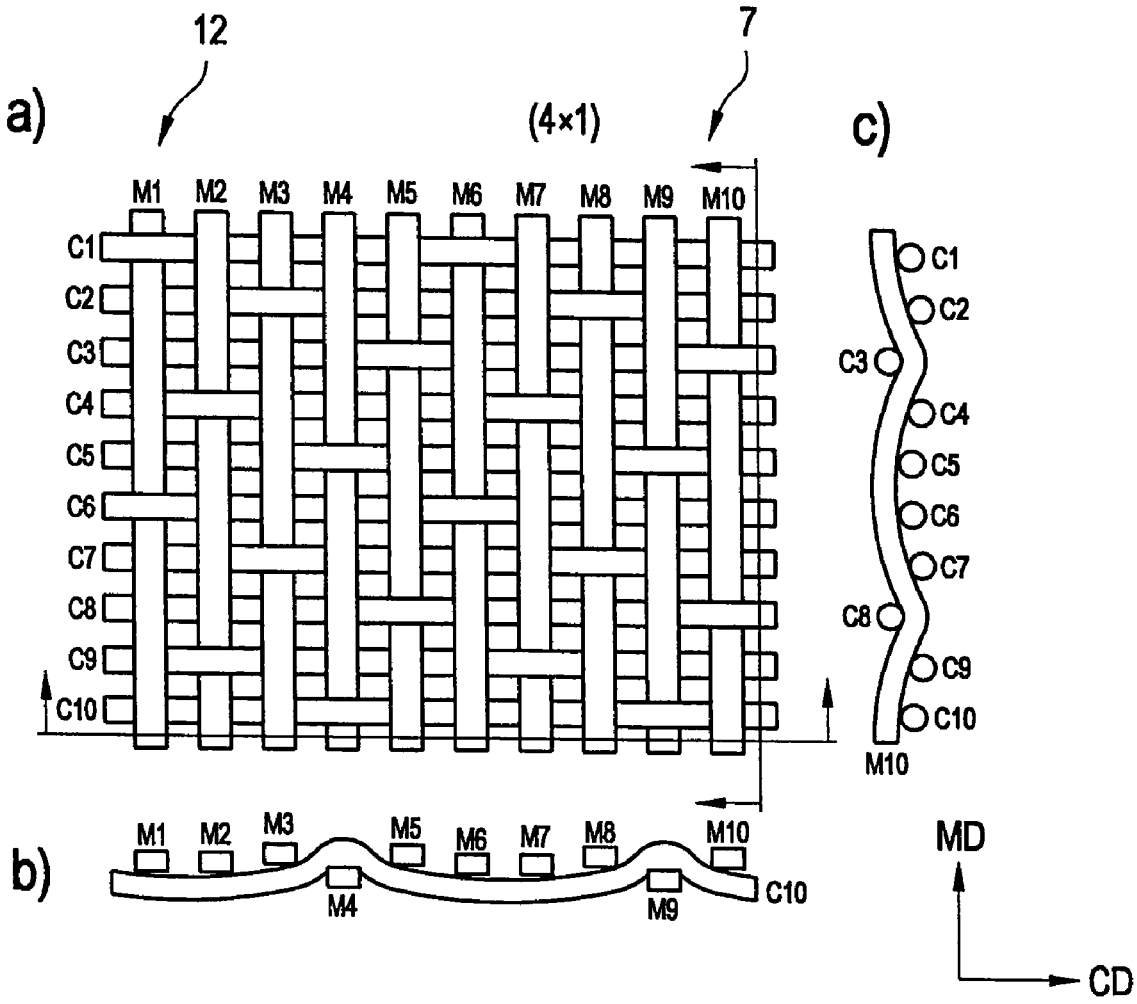
FIG. 3 is a top view of the paper contacting surface and corresponding side views in MD and CD direction on a TAD fabric in accordance with the present invention.

FIG. 3*a* shows a top view onto TAD fabric 7 which is in accordance with the present invention. TAD fabric 7 has the same weave design as fabric 21. This denotes in CD direction TAD fabric 7 has a "over 1 under 4" and in MD direction a "over 4 under 1" weave repeat. The weave pattern is formed by interweaving of the warp yarns M1, M2, M3, . . . extending into MD direction with the weft yarns C1, C2, C3, . . . extending into CD direction.

Warps M1, M2, M3, . . . are circular and wefts C1, C2, C3, . . . are rectangular shaped to provide a flat paper side 12 with a contact area being in the range of 20% to 30% preferably 25%. According to the present invention neither wefts nor warps have been sanded after weaving.

FIG. 3*b* shows a side view in CD direction of TAD fabric 7 along weft yarn C10. As can be seen C10 first passes over one warp before floating under four consecutive warps. For example, C10 passes over M4 and floats under M5 to M8 before passing over M9 and so on.

Further it can be seen that warps M1 to M10 have rectangular cross sectional shape. By providing flat warps a flattened paper, side 12 with increased contact area is formed. In accordance with the present invention, the warp yarns M1 to M10 have an aspect ratio of about 1.27:1.

FIG. 3*c* shows a side view in MD direction of TAD fabric 7 along warp yarn M10. As can be seen M10 first floats over four consecutive wefts before passing under one weft. For example, M10 floats over C4 to C7 and passes under C3 before and so on. In contrary to the warps M1 to M10 all the wefts C1 to C10 have a circular shape.

Figure 4:
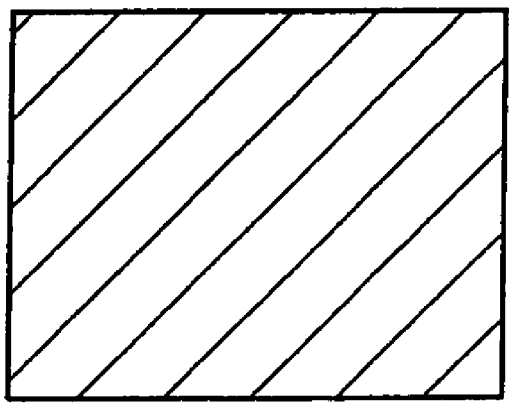

FIG. 4 illustrates a possible cross-section of a warp yarn for use in the fabric of the invention. Yarn 13 is made from a thermoplastic material. Yarn 13 has a rectangular cross sectional shape. The aspect ratio=w/h, so that if h=1 mm then w=1.27 mm in an embodiment.

Figure 5:
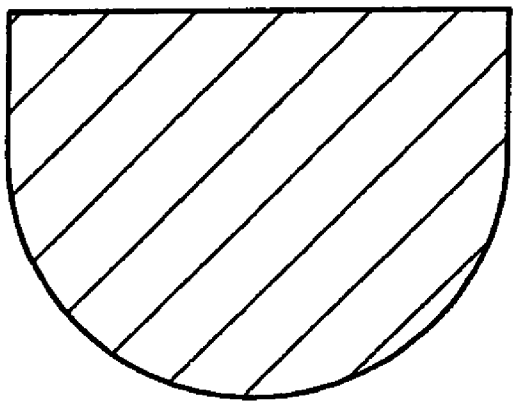
FIGS. 4 and 5 are magnified cross-sectional views of warp yarns used in the TAD fabric of the present invention.

FIG. 5 shows a yarn 32 having a semicircle with a rectangle cross-sectional shape, which may have been extruded in this form, as may the rectangular cross-section yarn 31 showing in FIG. 4.

Yarns may be made of other cross-sections, provided that their aspect ratios fall within the specified range.

Selection of the low aspect ratios set out in the present invention denotes that the cross-section approaches a square, and the yarns are dimensionally equivalent to a round yarn which would occupy the same weave space (i.e. width of yarn). None of the benefits, in terms of for example strength and wear resistance of the round yarn are lost, but the contact area has increased. In TAD fabrics abrasion is a major problem, and the present invention makes possible the use of a flatter yarn which has the same abrasion resistance, tensile strength, stability and modulus as a successfully used round yarn and occupying a similar weave space, and a fabric with an improved surface contact area can be produced. Further there is no need to change weave patterns as the flattened yarns lie comfortably in the paths of the corresponding round yarns which they replace. The following table illustrates this effect:

| Diameter of Round Yarn | Thickness of Flat Yarn | Width of Flat Yarn | Aspect Ratio |
|---|---|---|---|
| 0.3 mm | 0.235 mm | 0.3 mm | 1.27 |
| 0.35 mm | 0.275 mm | 0.35 mm | 1.27 |
| 0.4 mm | 0.315 mm | 0.4 mm | 1.27 |
| 0.45 mm | 0.355 mm | 0.45 mm | 1.27 |

Definition how the contact area of a TAD fabric according to the present invention is measured:

Procedure

1. Place pressure sensitive film onto the fabric with the whiter side of the film in contact with the fabric and stick into position using sellotape.
2. Using the smooth base of a biro pen press onto the film using small circular movements, keep the pen upright or the edge of the pen will press into the fabric giving a false reading. (An impression 15 mm in diameter is sufficient.)
3. Place a black strip of masking tape onto a yellow "post it" pad.
4. Place the impression strip onto the "post it" pad and stick into position using sellotape.
5. Switch video microscope on and place the pad under the lens.
6. Set magnification to ×35 and alter focus to give a sharp image.
7. Position x and y axis dotted lines using the arrow keys to cover a 4 end x4 pick repeat.
8. Take a micrograph of the image by pressing the Memory button first and then the Print button a few seconds later. (The picture flickers when the memory button is pressed, this is normal and shows the image has been captured.)
9. Wait for the print to be processed, this can take up to a minute.
10. When the print has been processed measure across the x and y axis using the steel ruler and record the measurement to the nearest half millimeter (e.g., 36.5 mm×41.5 mm).
11. Convert this measurement to square inches.
    Example: 36.5 mm divided by 25.4=1.437 inches.
    41.5 mm divided by 25.4=1.638 inches.
    1.437×1.638=2.354 square inches.
12. Place the contact area chart over the print and count the number of dots that lie completely over the warp and weft impressions taking care to count only the dots that lie within the dotted lines on the print.
13. Divide the number of dots recorded by the area measured in square inches. In the example shown above the area is 2.354 square inches so if 58 dots had been counted the Contact Area would be: 58 divided by 2.354=24.6%
14. The tolerance allowed is +/−1% so if the required contact area is 25% then a reading of 24% up to 26% is acceptable.
15. If the required degree of sanding has not been obtained extra passes can be given but take care, if too much has been taken off this cannot be put back on!

Note: It is worth taking 3 or 4 readings using different parts of the chart to record the contact area as a single reading is not necessarily representative of the degree of sanding obtained.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A through-air dryer fabric, comprising:

a warp yarn system;

a weft yarn system interweaved with said warp yarn system, wherein at least one of said warp yarn system comprises a plurality of flat warp yarns and said weft yarn system comprises a plurality of flat weft yarns, at least one of said plurality of flat warp yarns and said plurality of flat weft yarns having said yarns with an aspect ratio of approximately between 1.15:1 to 1.35:1, said plurality of flat warp yarns and said plurality of flat weft yarns having not been subjected to a flattening process after weaving of said through-air dryer fabric;

a paper side of said interweaved said warp yarn system and said weft yarn system, said paper side having a contact area approximately between 20% and 30%; and wherein said through-air dryer fabric has an air permeability approximately between 600 cfm to 1000 cfm.

2. The through-air dryer fabric of claim 1, wherein at least one of said plurality of flat weft yarns and said plurality of flat warp yarns have been manufactured by an extrusion process.

3. The through-air dryer fabric of claim 1, wherein at least one of said plurality of flat weft yarns and said plurality of flat warp yarns have one of a rectangular cross-section, a semi-circular cross-section, an oval cross-section, and an elliptical cross-section.

4. The through-air dryer fabric of claim 3, wherein at least one of said plurality of flat weft yarns and said plurality of flat warp yarns have said rectangular cross-section with rounded edges.

5. The through-air dryer fabric of claim 1, wherein at least one of said plurality of flat weft yarns and said plurality of flat warp yarns have a flat top surface and a flat bottom surface with convex side surfaces.

6. The through-air dryer fabric of claim 1, wherein at least one of said plurality of flat weft yarns and said plurality of flat warp yarns have an aspect ratio of 1.27:1.

7. The through-air dryer fabric of claim 1, wherein said through-air dryer fabric has an air permeability approximately between 400 cfm to 1000 cfm.

* * * * *